US009226081B1

(12) United States Patent
Ye

(10) Patent No.: US 9,226,081 B1
(45) Date of Patent: Dec. 29, 2015

(54) DIGITAL ELECTRET MICROPHONE AND THE CONNECTION STRUCTURE THEREOF

(71) Applicants: Zilltek Technology (Shanghai) Corp., Shanghai (CN); Zilltek Technology Corp., Hsinchu (TW)

(72) Inventor: Jinghua Ye, Shanghai (CN)

(73) Assignees: Zilltek Technology (Shanghai) Corp., Shanghai (CN); Zilltek Technology Corp., Hsinchu (TW)

( * ) Notice: Subject to any disclaimer, the term of this patent is extended or adjusted under 35 U.S.C. 154(b) by 0 days.

(21) Appl. No.: 14/550,476

(22) Filed: Nov. 21, 2014

(51) Int. Cl.
*H04R 19/01* (2006.01)
*H04R 1/08* (2006.01)
*H04R 1/04* (2006.01)

(52) U.S. Cl.
CPC ..... *H04R 19/016* (2013.01); *H04R 1/04* (2013.01); *H04R 1/08* (2013.01)

(58) Field of Classification Search
CPC ..... H01L 25/0657; H01L 24/01; H01L 24/02; H01L 24/10
See application file for complete search history.

(56) References Cited

U.S. PATENT DOCUMENTS

2008/0112585 A1* 5/2008 Izuchi et al. ..... 381/361
2013/0058495 A1* 3/2013 Furst et al. ..... 381/80

FOREIGN PATENT DOCUMENTS

CN 202907182 4/2013
CN 103209379 7/2013

* cited by examiner

*Primary Examiner* — Selim Ahmed
*Assistant Examiner* — Wasiul Haider
(74) *Attorney, Agent, or Firm* — Myron Greenspan Lackenbach Siegel LLP

(57) ABSTRACT

The invention relates to the technical field of voice processing equipment, more specifically, to a microphone. A new-type microphone structure comprises a first layer structure, a second layer structure located on the first layer structure, a microphone acoustic cavity formed by the first layer structure and the second layer structure, at least one acoustic hole for acquiring sound signals, which is arranged on the microphone acoustic cavity, and a dustproof component which covers the inside of the acoustic hole. The invention can prevent most of the dust particles and the moisture and the siphoning effect when in actual use, which does not need to change the size of the existing microphone. It can be used in thin structures, and can prolong the service life of the microphone.

9 Claims, 2 Drawing Sheets

DIGITAL ELECTRET MICROPHONE AND THE CONNECTION STRUCTURE THEREOF

TECHNICAL FIELD

The invention relates to the technical field of electronics, more specifically, to a digital electret microphone and the connection structure thereof.

BACKGROUND OF THE INVENTION

The digital electret microphone is provided with an analog-to-digital conversion on the basis of traditional electret microphone, in order to output the digital electric signal and increase the ability of anti-electromagnetic interference for the microphone and improve the quality of output signal of the microphone. However, being different from the two pin structure of the traditional electret capacitance microphone, the connection terminals of the digital electret capacitance microphone are 4 pin, which respectively are: Power Input End VDD, Clock Input End CLK, Data Output DATA and Ground Terminal GND. In the prior art, the 2 connection pins of the circular patch packaging structure of the traditional electret capacitance microphone adopts the ring structure to make it easy to implement surface mount technology. However, if the 4 pin digital electret capacitance microphone adopts the circular packaging structure either, it is difficult to implement the automatic surface mount technology. So the people skilled in the art has to set the digital electret capacitance microphone as a square packaging structure to make it easier to implement the automatic surface mount technology, which wastes the existed production line of the circular patch packaging and increases enterprise production cost.

SUMMARY OF THE INVENTION

The invention aims to provide a connection structure of a digital electret microphone for solving the above technical problems.

The invention also aims to provide a digital electret microphone for solving the above technical problems.

The technical problems solved by the invention can be implemented by the following technical proposal:

A connection structure of a digital electret microphone, which is used to mount the digital electret microphone on a printed circuit board, wherein the digital electret microphone has a circular packaging structure, the connecting surface of the circular packaging structure has at least five pins; the PCB has a circular mount field provided with at least four bonding pads, the five pins are in contact with the four bonding pads.

Preferably, wherein the pins includes a first pin located at the center of the circle, a second pin surrounding the first pin, a third pin, a fourth pin and a fifth pin configured between the first pin and the second pin at equal interval.

Preferably, the bonding pad includes a first bonding pad located in the center of the circular mount field, a second bonding pad which embraces the first bonding pad, a third bonding pad and a fourth bonding pad which are between the first bonding pad and the second bonding pad. The third bonding pad and the fourth bonding pad are set in an opposite position.

Preferably, the first pin is in contact with the first bonding pad, the second pin is in contact with the second bonding pad;

At least one of the third pin, the fourth pin and the fifth pin is in contact with the third bonding pad, at least one of the third pin, the fourth pin and the fifth pin is in contact with the fourth bonding pad.

Preferably, the third pin, the fourth pin and the fifth pin are three sections of the first category of the curved connection structure which embrace the circular structure of the first pin. The three sections of the first category of the curved connection structure are set with the same pace.

Preferably, the third bonding pad and the fourth bonding pad are two pieces or the second arc-shaped connection structure which surrounds the same circular structure of the first bonding pad.

Preferably, the length of the third bonding pad is greater than that of the third pin, the fourth pin or the fifth pin; the length of the fourth bonding pad is greater than that of the third pin, the fourth pin or the fifth pin.

The present invention further provides a digital electret microphone, comprising the connection structure of the digital electret microphone as disclosed above, the third pin is the data output end, the fourth pin is the clock input end, the fifth pin is the controlled switch terminal. The fifth pin is in contact with the third pin or the fourth pin under the influence of a control signal, so that the pin and the corresponding bonding pad can be properly linked with each other;

Preferably, the determining circuit generates the control signal based on the signal input or output status the pin.

Preferably, the determining circuit located in the interior of the digital electret microphone is in contact with the third pin, the fourth pin and the fifth pin.

Preferably, the first pin and the first bonding pad are the power input end, both the second pin and the second bonding pad are the ground terminal; alternatively both the first pin and the first bonding pad are the ground terminal, both the second pin and the second bonding pad are the power input end.

By adopting the above-mentioned technical solutions, the present invention is able to achieve the adaptive mounting for the circular packaging structure of the digital electret microphone, reuse the existed production line process, and reduce the enterprise producing cost.

BRIEF DESCRIPTIONS OF THE DRAWINGS

DETAILED DESCRIPTION

The technical proposal in the present invention will be described clearly and completely in combination with the following Figures. Obviously, the embodiment, which is described before, is only part of the embodiments, not whole embodiments in the present invention. Based on the embodiment in the present invention, the common artisan of this field getting all other embodiments without creative working, are in the protection of the invention.

It should be noted that without conflict, the embodiment and the character of the embodiment can be combined each other in the present invention.

The present invention will be further illustrated in combination with the following Figures and embodiments. However, it should not be deemed as limitations of the present invention.

Figure 1:
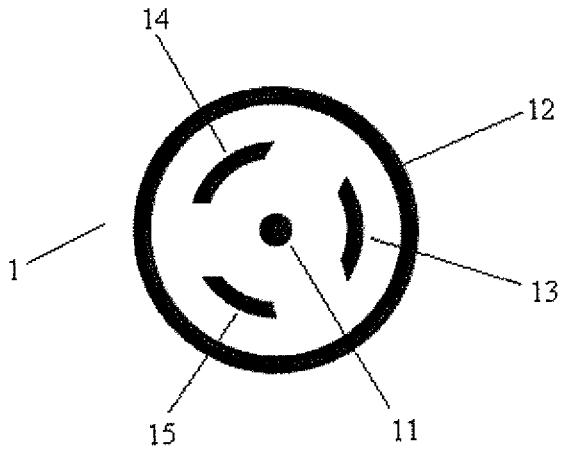
FIG. 1 illustrates a structure schematic of the pin distribution of the connection surface of the digital electret microphone in the present invention.
Figure 2:
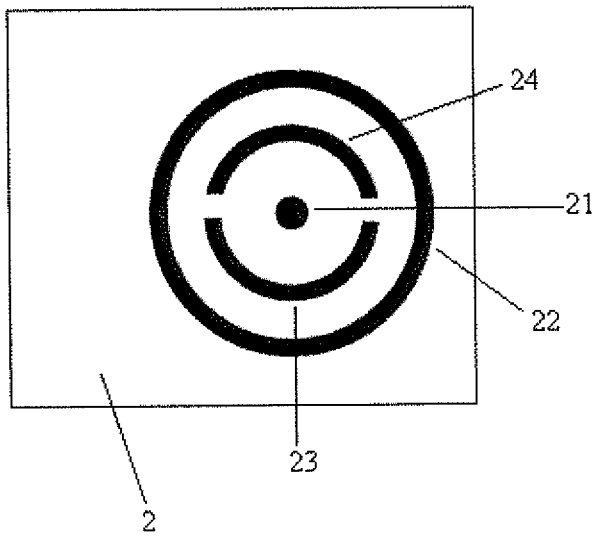
FIG. 2 illustrates a structure schematic of the pan distribution of the circular mount field of the printed circuit board in the present invention.
Figure 3:
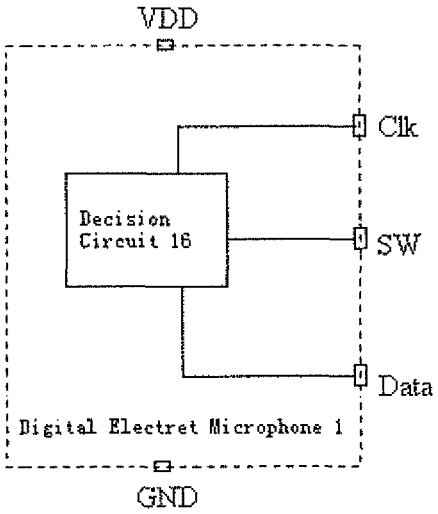
FIG. 3 illustrates a structure schematic of internal system structure of the digital electret microphone in the present invention.

Referring to FIGS. 1 and 2, a connection structure of digital electret microphone, which is used for mounting the digital electret microphone 1 on a PCB 2, wherein the digital electret microphone 1 has the circular packaging structure, of which there is at least five pins of the connection surface; the PCB 2 has a circular mount field, on which there is at least four bonding pads, the five pins are in contact with the four bonding pads.

Preferably, as the embodiment of the invention, the pin includes the first pin 11 located at the center; the second pin 12 which embraces the first pin 11; the third pin 13, the fourth pin 14 and fifth pin 15 which are between the first pin 11 and the second pin 12 with the same pace.

Preferably, as the embodiment of the invention, the pad includes the first bonding pad 21 located in the center of the circular mount field, the second bonding pad 22 which embraces the first bonding pad 21, the third bonding pad 23 and the fourth bonding pad 24 which are between the first bonding pad 21 and the second bonding pad 22. The third bonding pad 23 and the fourth bonding pad 24 are set in an opposite position.

Preferably, as the embodiment of the invention, the first pin 11 is in contact with the first bonding pad 21, the second pin 12 is in contact with the second bonding pad 22.

At least one of the third pin 13, the fourth pin 14 and the fifth pin 15 is in contact with the third bonding pad 23, at least one of the third pin 13, the fourth pin 14 and the fifth pin 15 is in contact with the fourth bonding pad 24.

Preferably, according to one embodiment of the invention, the third pin 13, the fourth pin 14 and the fifth pin 15 are three sections of the first category of the curved connection structure which embrace the circular structure of the first pin 11. The three sections of the first category of the curved connection structure are set with the same pace. As a concrete embodiment, the length of the first category of the curved connection structure is one six circle length of the same circular structure.

The third pin 13, the fourth pin 14, the fifth pin 15 of the present invention can adopts other shapes of connection structure as long as they are set between the first pin 11 and the second pin 12. To meet the needs of the invention, the third pin 13, the fourth pin 14, the fifth pin 15 can be the glyph arrangement.

Preferably, as the embodiment of the invention, the third bonding pad 23 and the fourth bonding pad 24 are two sections of the second category of the curved connection structure which embrace the circular structure of the first bonding pad 21. The length of the second category of the curved connection structure is smaller than the half circle length of the same circular structure but greater than the length of the first category of the curved connection structure.

In the same way, the third bonding pad 23 and fourth bonding pad 24 of the invention can adopt other shape of pan, as long as they are used for the propose of the invention.

The shape and size of the three sections of the first category of the curved connection structure are equal, the shape and size of the two sections of the second category of the curved connection structure are equal.

Preferably, as the embodiment of the invention, the length of the third bonding pad 23 is greater than any length of the third pin 13, the fourth pin 14 and the fifth pin 15; the length of the fourth bonding pad 24 is greater than any length of the third pin 13, the fourth pin 14 and the fifth pin 15.

In the present invention, both the first pin 11 and the first bonding pad 21 are the power input end, both the second pin 12 and the second bonding pad 22 are the ground terminal; alternatively both the first pin 11 and the first bonding pad 21 are the ground terminal, both the second pin 12 and the second bonding pad 22 are the power input end.

The invention also provide a digital electret microphone 1 which has the connection structure mentioned above, whose third pin 13 is the data output, the fourth pin 14 is the clock input end, the fifth pin 15 is the controlled switch terminal. The fifth pin 15 gets in contact with the third pin 13 or the fourth pin 14 by the effect of a control signal, so that the correct connection is achieved between the pin and the corresponding pad.

The control signal is generated by a determining circuit 16, the determining circuit 16 depends on the input or output status of the signal of the pin to generate the control signal.

Preferably, as the embodiment of the invention, the determining circuit 16 is located in the interior of the digital electret microphone 1. The determining circuit gets in contact with the third pin 13, the fourth pin 14 and the fifth pin 15 by electric.

The determining method for the digital electret microphone of the present invention includes the following steps:

The determining circuit determines the connection of the pin and pad based on the input of the clock signal of the external circuit, the decisions of the determining circuit are described as follows:

| | | | |
|---|---|---|---|
| The third bonding pad | The third pin<br>The third pin and the fifth pin<br>The third pin and the fourth pin | The fourth bonding pad | The fourth pin and the fifth pin |
| The third bonding pad | The fourth pin<br>The fourth pin and the fifth pin<br>The fourth pin and the third pin | The fourth bonding pad | The third pin and the fifth pin |
| The third bonding pad | The fifth pin<br>The fifth pin and the third pin<br>The fifth pin and the fourth pin | The fourth bonding pad | The third pin and the fourth pin |
| The fourth bonding pad | The third pin<br>The third pin and the fifth pin<br>The third pin and the fourth pin | The third bonding pad | The fourth pin and the fifth pin |
| The fourth bonding pad | The fourth pin<br>The fourth pin and the fifth pin<br>The fourth pin and the third pin | The third bonding pad | The fourth pin and the fifth pin |
| The fourth bonding pad | The fifth pin<br>The fifth pin and the third pin<br>The fifth pin and the fourth pin | The third bonding pad | The third pin and the fourth pin |

In the first situation, the determining circuit determines whether one of the third pin, the fourth pin, the fifth pin has been input the signal, so that the pins received the signal can be the clock input end.

If there is a pin received the clock signal, the other two pins can be set as data output.

If there are two pins received the signal, the determining circuit sets both the two pins as the clock input, and sets the rest one as data output to output the digital signal.

If the third bonding pad outputs the clock signal as the table described above:

1) When only the third pin receives the clock signal, sets the fourth pin and the fifth pin as data output together.
2) When the third pin and the fifth pin are received the clock signal either, sets the fourth pin as the data output.
3) When the third pin and the fourth pin are received the clock signal either, sets the fifth pin as the data output, because the fifth pin is set as controlled switch terminal by default, the controlled switch terminal cuts over the internal circuit by the effect of a control signal to output the digital signal.

In second situation, the determining circuit sets the third pin as the data output, determines whether the third bonding pad or the fourth bonding pad receives the signal, then it thoughts the pan received the signal as the one connected to the third pin, and sets the other pan as the clock input end, which sends at least one clock signal to the fourth pin or the fifth pin.

Then, the determining circuit checks whether the fifth pin has received the clock signal, if not, the determining circuit sets the third pin and the fifth pin as the data output together, or sets the third pin as the data output separately; if yes, the determining circuit sets the fifth pin and the fourth pin as the clock input end together, or sets the fifth pin as the clock input end, as the table listed above.

1) When the fourth bonding pad gets in contact with the third pin separately, the fourth bonding pad receives the digital signal, the third bonding pad gets in contact with the fourth pin and the fifth pin. The fourth pin and the fifth pin can be the clock input end together.
2) When the fourth bonding pad gets in contact with the third pin and fifth pin, the third pin and fifth pin can be the data output together, the fourth pin can be the clock input separately.
3) When the fourth bonding pad gets in contact with the third pin and the fourth pin, the third pin and fourth pin can be the data output together; the fifth pin can be the clock input end separately. Of course, the controlled switch cuts over internal circuit by the effect of the control signal to receive the external clock signal.

The other situations are same as these ones and it would not be described any more.

The disclosure described above is preferred embodiment, it does not limit the method and scope of the invention. It should be understood that the proposal obtained from the equivalent replacement and apparent modifications through the instruction and figure of the invention will be covered within the scope of the invention to those skilled in the art.

The invention claimed is:

1. A connection structure for mounting a digital electret microphone having a circular packaging structure with a connecting surface having at least five pins, comprising a printed circuit board (PCB); having a circular mount field provided with at least four bonding pads, said at least five pins being arranged for contact with said four bonding pads, wherein the pins include a first pin located at the center of the circle, a second pin surrounding the first pin, a third pin, a fourth pin and a fifth pin configured between the first pin and the second pin at equal intervals.

2. The connection structure of the digital electret microphone as disclosed in claim 1, wherein the bonding pad includes a first bonding pad located in the center of the circular mount field, a second bonding pad which embraces the first bonding pad, a third bonding pad and a fourth bonding pad which are between the first bonding pad and the second bonding pad; the third bonding pad and the fourth bonding pad are set in an opposite position.

3. The connection structure of the digital electret microphone as disclosed in claim 2, wherein the first pin is in contact with the first bonding pad, the second pin is in contact with the second bonding pad;

at least one of the third pin, the fourth pin and the fifth pin is in contact with the third bonding pad, at least one of the third pin, the fourth pin and the fifth pin is in contact with the fourth bonding pad.

4. The connection structure of the digital electret microphone as disclosed in claim 3, wherein the third pin, the fourth pin and the fifth pin are three sections of a first arc-shaped connection structure which surround the circular structure of the first pin, the three sections of the first arc-shaped connection structure are set with the same pace.

5. The connection structure of the digital electret microphone as disclosed in claim 3, wherein the third bonding pad and the fourth bonding pad are two sections of a second arc-shaped connection structure which surrounds the same circular structure of the first bonding pad.

6. The connection structure of the digital electret microphone as disclosed in claim 3, wherein the length of the third bonding pad is greater than that of the third pin, the fourth pin or the fifth pin; the length of the fourth bonding pad is greater than that of the third pin, the fourth pin or the fifth pin.

7. A digital electret microphone, wherein, comprising the connection structure of the digital electret microphone as disclosed in claim 3, the third pin is the data output end, the fourth pin is the clock input end, the fifth pin is the controlled switch terminal; the fifth pin is in contact with the third pin or the fourth pin under the influence of a control signal, so that the pin and the corresponding bonding pad can be properly linked with each other;

the control signal is generated by a determining circuit, the determining circuit generates the control signal based on the signal input or output status the pin.

8. The digital electret microphone as disclosed in claim 7, the determining circuit located in the interior of the digital electret microphone is in contact with the third pin, the fourth pin and the fifth pin.

9. The digital electret microphone as disclosed in claim 7, wherein the first pin and the first bonding pad are the power input end, both the second pin and the second bonding pad are the ground terminal; alternatively both the first pin and the first bonding pad are the ground terminal, both the second pin and the second bonding pad are the power input end.

* * * * *